United States Patent [19]

Oblad et al.

[11] 4,298,457

[45] Nov. 3, 1981

[54] HYDROPYROLYSIS PROCESS FOR UPGRADING HEAVY OILS AND SOLIDS INTO LIGHT LIQUID PRODUCTS

[75] Inventors: Alex G. Oblad; Joseph Shabtai; Rasmasamy Ramakrishnan, all of Salt Lake City, Utah

[73] Assignee: University of Utah, Salt Lake City, Utah

[21] Appl. No.: 137,083

[22] Filed: Apr. 3, 1980

Related U.S. Application Data

[63] Continuation of Ser. No. 941,840, Sep. 11, 1978, abandoned.

[51] Int. Cl.[3] ..... C10G 47/22

[52] U.S. Cl. ..... 208/107; 208/56; 208/264

[58] Field of Search ..... 208/8, 56, 106–107, 208/264

[56] References Cited

U.S. PATENT DOCUMENTS

| | | | |
|---|---|---|---|
| 2,989,461 | 6/1961 | Eastman et al. | 208/107 |
| 3,044,948 | 7/1962 | Eastman et al. | 208/107 |
| 3,083,244 | 3/1963 | Sanford et al. | 208/107 |
| 3,089,843 | 5/1963 | Eastman et al. | 208/107 |
| 3,288,704 | 11/1966 | O'Hara et al. | 208/106 |
| 3,707,461 | 12/1972 | Gatsis | 208/111 |
| 3,844,937 | 10/1974 | Wolk | 208/108 |
| 4,176,051 | 11/1979 | Ternan et al. | 208/112 |
| 4,213,847 | 7/1980 | Chen et al. | 208/111 |

*Primary Examiner*—Delbert E. Gantz
*Assistant Examiner*—G. E. Schmitkons
*Attorney, Agent, or Firm*—H. Ross Workman; J. Winslow Young; Allen R. Jensen

[57] ABSTRACT

A hydropyrolysis process for upgrading heavy, high molecular weight feedstocks such as coal-derived liquids, petroleum crudes, tar sand bitumens, shale oils, bottom residues from process streams, and the like, to lighter, lower molecular weight liquid products. The process includes subjecting the feedstocks to pyrolysis in the presence of hydrogen under carefully controlled conditions of temperature and pressure. The process can be defined as hydrogen-modified, thermal cracking in the specific temperature range of 450° C. to 650° C. and in the hydrogen pressure range of about 120 psi to 2250 psi. The amount of hydrogen present can be varied according to the type of feedstock and the liquid product desired. Although the hydrogen is not consumed in large amounts, it does participate in and modifies the process, and thereby provides a means of controlling the process as to the molecular weight range and structural type distribution of the liquid products. The presence of hydrogen also inhibits coke formation. The process also eliminates the requirement for a catalyst so that the reaction will proceed in the presence of heavy metal contaminants in the feedstock which contaminants would otherwise poison any catalyst.

6 Claims, No Drawings

HYDROPYROLYSIS PROCESS FOR UPGRADING HEAVY OILS AND SOLIDS INTO LIGHT LIQUID PRODUCTS

This is a continuation, of application Ser. No. 941,840, filed Sept. 11, 1978 now abandoned.

BACKGROUND

1. Field of the Invention

This invention relates to a hydropyrolysis process and, more particularly, to a hydropyrolysis process under carefully selected and controlled conditions of temperature and pressure wherein heavy, high molecular weight feedstocks are cracked in the presence of hydrogen to yield lighter, lower molecular weight, liquid products.

2. The Prior Art

Thermal cracking was the primary process for production of gasoline from crude petroleum until the late 1930's. Thermal cracking was employed to increase the yield of gasoline either by direct processing of heavy feeds, or indirectly, through the production of light olefins, which were then subjected to polymerization. Subsequently, it was gradually replaced by the more efficient catalytic cracking and reforming. Thermal processes of importance during and before the Second World War included cracking, visbreaking, coking, reforming, alkylation and polymerization. Thermal reforming processes were used to convert low quality gasoline and naphtha into high-octane gasoline by various transformations, e.g. isomerization and dehydrogenation, while thermal alkylation was employed in the production of blending components for aviation fuel. Another important thermal process, used in England during the Second World War for the manufacture of aromatics and olefins, was the Catarole process. In this process, highly naphthenic feeds were cracked to mono- and diolefins, which, through resynthesis at extended reaction time, gave monocyclic and polycyclic aromatic compounds.

At present, thermal cracking processes represent a relatively minor part (less than 10%) of the modern refining capacity in the United States. Such processes are being used for upgrading the heavy liquids and for production of petrochemicals. In particular, visbreaking and coking are two important applications for the production of fuels from heavy oils. Visbreaking is a mild form of thermal cracking which reduces the viscosity of feedstocks, such as vacuum resids and heavy gas oils. The process yields mainly middle distillate fuel, accompanied by lower amounts of gasoline, making it a suitable process in case the gasoline demand is low compared to that for middle distillate. Coking processes are based on the principle of carbon rejection, i.e. increase in the hydrogen/carbon ratio of distillable liquid products at the expense of partial carbonization of the starting material. Coking is applied for upgrading of feeds such as reduced crudes, vacuum resids, shale oils, tar-sand liquids, coal tar, and gilsonite. When such heavy liquids are heated to 480°–565° C. there is extensive cracking of large molecules yielding free radicals, which are stabilized by abstraction of hydrogen from other molecules. Continuation of this hydrogen transfer process leads to a liquid product (gas oil) which is richer in hydrogen, and a solid product (coke) which is poorer in hydrogen, as compared to the feed.

Another important thermal process is the steam cracking of $C_2$–$C_4$ paraffins, naphtha, and gas oil for the manufacture of $C_2$–$C_4$ olefins, which are important starting materials in the petrochemical industry.

With decreasing petroleum resources, increased interest is being directed toward the production of synthetic crudes from coal, tar sands, and oil shale. These crudes, because of their high viscosity and high molecular weight, present unique production, handling and processing problems. Present processes for upgrading heavy crude liquids are based either on addition of hydrogen or rejection of carbon. The addition of hydrogen to these heavy materials has proven to be very expensive. Accordingly, carbon rejection (coking) is currently the most popular method for upgrading heavy crudes. The disadvantage of coking is that it converts a substantial portion (10–25%) of the feed material to coke.

In view of the foregoing, it would be a significant advancement in the art to provide a process which will either totally or at least partially eliminate coke formation while increasing the liquid yield from high molecular weight feedstocks. It would also be an advancement in the art to provide a non-catalytic process for producing lower molecular weight, liquid hydrocarbons from higher molecular weight hydrocarbons in the presence of heavy metal contaminants. Such a process is disclosed and claimed herein.

BRIEF SUMMARY AND OBJECTS OF THE INVENTION

The present invention relates to a novel hydropyrolysis process for upgrading heavier, higher molecular weight feedstocks to lighter, lower molecular weight, liquid products. The process includes pyrolysis in the presence of hydrogen at an elevated, carefully controlled temperature within the range of about 450° C.–650° C. and a pressure within the range of about 120 psi to 2250 psi. Advantageously, the process proceeds in the absence of a catalyst and in the presence of heavy metal contaminants within the feedstock.

It is, therefore, a primary object of this invention to provide improvements in the production of lower molecular weight, liquid products from higher molecular weight feedstocks.

Another object of this invention is to provide improvements in the process for converting higher molecular weight feedstocks into lower molecular weight, liquid product.

Another object of this invention is to provide a process for producing lower molecular weight, liquid products from higher molecular weight feedstock.

Another object of this invention is to provide a process for producing lower molecular weight, liquid products from higher molecular weight feedstocks in the presence of heavy metal contaminants within the feedstock.

Another object of this invention is to provide a process for the hydropyrolysis of higher molecular weight feedstocks to produce lower molecular weight, liquid products in the absence of a catalyst.

These and other objects and features of the present invention will become more fully apparent from the following description and appended claims.

DETAILED DESCRIPTION OF THE PREFERRED EMBODIMENTS

Introductory Discussion

Hydropyrolysis may be defined as thermal cracking under hydrogen pressure. Until the present, hydropyrolysis has been employed in industry to a lesser extent than conventional thermal cracking processes although two important areas of present application for hydropyrolysis are hydrodealkylation and hydrogasification.

Hydrodealkylation is a process for production of unsubstituted arenes from alkylsubstituted arenes. This process is preferred to catalytic processes because of its simplicity, ease of operation for extended periods of time, higher selectivity, and lower investment and operation costs. The most important among hydrodealkylation processes is the manufacture of benzene from alkylbenzenes.

Hydrogasification is the process by which different distillates (usual b.p. range up to 350° C.) are thermally cracked in the presence of hydrogen to produce a gaseous product rich in methane. An important hydrogasification process is the British Gas Council's Gas Recycle Hydrogenation (GRH) Process. Previously, the GRH product was blended mainly with gas from a coal gasification plant, but presently it is used to enrich the gas from steam/naphtha reformers using feeds having a boiling point higher than 350° C.

Recently, interest in hydropyrolysis as a hydrocarbon conversion process has been indicated in the publication *Hydrocarbon Processing,* "New Roue to Ethylene-Hydropyrolysis" see Barre, Chalavekilian, and R. Dumon, *Chemical Engineering News* November 1976, pages 176–178. This publication relates to the investigation of hydropyrolysis as a process for producing olefins from heavy, liquid hydrocarbons. The hydropyrolysis reaction is carried out under very drastic conditions (800°–900° C., and pressures of up to about 300 psi), using a residence time of less than 0.1 seconds. A substantial increase in the yield of low olefins was obtained as compared to that in the conventional steam cracking process. Other processes have been developed to produce methane, benzene and ethane by the hydropyrolysis of feedstocks such as kerosene.

Further, one company has developed a process for production of methane, benzene and ethane by hydropyrolysis of kerosine, and another process, known as dynacracking, which employs hydropyrolysis for upgrading of resids. The latter process utilizes a special type of reactor, the lower part of which is used as a gasifier to produce the synthesis gas necessary for the hydropyrolysis reaction.

Reported studies of the hydropyrolysis of ethane, propane, n-butane, and isobutane at 1000 psig and 600°–700° C., showed that propane hydropyrolysis is nearly 30 times faster than that of ethane. The rate constants for propane, n-butane, and isobutane hydropyrolysis were clearly higher than those found for ordinary thermal cracking. The important observation was also made that formation of aromatic hydrocarbons during hydropyrolysis of paraffins and cycloparaffins is gradually suppressed by increase in the concentration of hydrogen.

Others have studied the cracking of indan and tetralin in the presence of hydrogen at temperatures from 460°–540° C., total pressure from 10 to 160 atmospheres, and hydrogen/hydrocarbon ratios of 2 to 100. They reported that the hydroaromatic ring opens readily and that alpha-ring opening (cleavage of C-C bond adjacent to the benzene ring) is apparently preferred to beta-ring opening.

Hydropyrolysis of n-butylbenzene products mainly styrene, ethylbenzene, and toluene, whereas n-propylbenzene yields predominantly styrene and ethylbenzene. These products are believed to be formed mainly by decomposition of resonance-stabilized benzylic radicals, derived from the starting alkylbenzenes.

As mentioned previously, hydrodealkylation of alkylaromatics is a major process for production of unsubstituted arenes. Most important of these processes is the production of benzene from toluene, as about two thirds of the total toluene presently produced is dealkylated to benzene. Processing conditions for dealkylation are usually 600°–800° C. and 25–40 atm. During hydrodealkylation, hydropyrolysis of paraffins and naphthenes, present in the feed, also occurs. Hydropyrolysis is highly exothermic and the heat of reaction varies from 55–60 kcal/mol.

Researchers have also reported that hydrodealkylation of toluene follows first order with respect to toluene and one half order with respect to hydrogen. In the presence of excess hydrogen the reaction was much simpler, as compared to the complex pyrolysis process in its absence. The activation energies for hydrodealkylation were found to be about 45 kcal/mol for toluene, p-xylene and o-xylene, as compared to activation energies of 77.5, 76.2 and 74.8 kcal/mol, respectively, for low pressure thermal cracking of these compounds in the absence of hydrogen. Frequency factors for hydrodealkylation were also low, i.e. $10^8$, as compared to $10^{13}$ during thermal cracking. This has led to the conclusion that the reaction has a chain character in the presence of hydrogen. Later workers have reported an activation energy of 50–55 kcal/mol for the hydrodealkylation of toluene.

Framework and Objectives of the Present Invention

One of the main objectives of the present work was to try and develop a versatile hydropyrolysis process for heavy liquids, which would totally or partially eliminate undesirable coke formation while increasing the yield of light liquid products. In order to determine the optimal operating conditions for such a process an investigation of model compounds, e.g. n-paraffins, naphthenes, and naphthenoaromatics was first performed. (See Examples 1–6).

Using the technique developed in the operation of a bench-scale unit and on the basis of results obtained with model compounds a hydropyrolysis study of the following representative heavy liquids was undertaken: (a) Altamont crude (mostly paraffinic): (b) Utah tar sands (Asphalt Ridge) bitumen (mostly naphthenic); (c) a typical coal-derived liquid, i.e. Synthoil (mostly aromatic); (d) an Alberta (Canada) native black oil; and (e) a San Ardo (California) native oil. In this part of the work the objective was to try and develop hydropyrolysis as a process for conversion of heavy liquids or solids into light, pumpable liquids, with minimal consumption of hydrogen.

EXAMPLE 1

Pure grade n-hexadecane, 116 gram, was hydropyrolyzed at 575° C. and a hydrogen pressure of 500 psi, using an LHSV of 9.4 $hr^{-1}$ and a contact time of 18 seconds. The conversion was 87.5%. The product consisted of (a) 59.2% B. wt. of $C_1$–$C_4$ gases; (b) 32.04% b. wt. of $C_5$–$C_{10}$ paraffins and olefins; and (c) 8.43% b. wt. of $C_{11}$–$C_{15}$ paraffins and olefins. No product having molecular weight higher than the starting n-hexadecane was observed.

EXAMPLE 2

Pure grade n-hexadecane, 38.7 grams, was hydropyrolyzed at 575° C., and a hydrogen pressure of 500 psi, using an LHSV of 3.1 $hr^{-1}$ and a contact time of 3 seconds. The conversion was 70%. The product consisted of (a) 59.42% b. wt. of $C_1$–$C_4$ gases; (b) 26.39% b. wt. of $C_5$–$C_{10}$ paraffins and olefins; and (c) 14.10% b. wt. of $C_{11}$–$C_{15}$ paraffins and olefins. No product having molecular weight higher than the starting n-hexadecane was observed.

EXAMPLE 3

Pure grade n-hexadecane, 38.7 grams, was hydropyrolyzed at 575° C., and a hydrogen pressure of 2000 psi, using an LHSV of 3.1 $hr^{-1}$ and a contact time of 18 seconds. The conversion was 98.6%. The product consisted of (a) 88.86% b. wt. of $C_1$–$C_4$ gaseous components; (b) 10.69% b. wt. of $C_5$–$C_{10}$ paraffins and olefins; and (c) 0.44% b. wt. of $C_{11}$–$C_{15}$ paraffins and olefins. No product having molecular weight higher than the starting n-hexadecane were observed.

EXAMPLE 4

Pure grade n-hexadecane, 38.7 grams, was hydropyrolyzed at 525° C., a hydrogen pressure of 500 psi, using an LHSV of 3.1 $hr^{-1}$ and a contact time of 18 seconds. The conversion was 33.8%. The product consisted of (a) 52.89% b. wt. of $C_1$–$C_4$ gases; (b) 25.16% b. wt. of $C_5$–$C_{10}$ paraffins and olefins; and (c) 21.19% b. wt. of $C_{11}$–$C_{15}$ paraffins and olefins. No product having molecular weight higher than the starting n-hexadecane was observed.

EXAMPLE 5

Pure grade decalin, 44 gram, was hydropyrolyzed at 575° C., and a hydrogen pressure of 1000 psi, using a liquid hourly space velocity (LHSV) of 3.1 $hr^{-1}$ and a contact time of 18 seconds. The conversion was 57.4%. The product consisted of (a) 33.7% b. wt. of $C_1$–$C_4$ gaseous components (b) 66.3% b. wt. of liquid components, subdivided as follows: $C_5$–$C_8$ open-chain paraffins and olefins, 16.75%; $C_6$–$C_{10}$ cyclohexanes and cyclohexenes, 36.08%; $C_6$–$C_8$ arenes, 7.14%; and partially hydrogenated naphthalenes, 6.14% b. wt. No product having molecular weight heavier than the starting decalin were observed.

EXAMPLE 6

Pure grade decalin, 44 grams was hydropyrolyzed at 600° C., and a hydrogen pressure of 1000 psi, using an LHSV of 3.1 $hr^{-1}$ and a contact time of 18 seconds. The conversion was 87.5% b. wt. The product consisted of (a) 47.9% b. wt. of $C_1$–$C_4$ gaseous components and (b) 52.1% b. wt. of liquid components, subdivided as follows: 11.76% b. wt. of $C_5$–$C_8$ open-chain paraffins and olefins, 19.08% b. wt. of $C_6$–$C_{10}$ cyclohexanes and cyclohexenes, 16..02% b. wt. of $C_6$–$C_8$ arenes, and 5.29% b. wt. of partially hydrogenated naphthalenes. No product having molecular weight higher than the starting decalin were observed.

EXAMPLE 7

The starting material consisted of a heavy (initial b. p.=150° C.) and highly paraffinic feedstock (Altamont Crude), which distills to the extent of 90% in the range of 160°–500° C. Fifty-six grams of this feed was hydropyrolyzed at 550° C. and a hydrogen pressure of 1000 psi, using an LHSV of 2.9 $hr^{-1}$ and a contact time of 23 seconds. The product consisted of 76% b. wt. of light liquid (API gravity=53.0; distillation range, 20°–350° C.) and 24% b. wt. of $C_1$–$C_4$ gaseous products.

EXAMPLE 8

The feedstock was the same as in Example 7. Seventy-two grams of this feed was hydropyrolyzed at 575° C. and a hydrogen pressure of 250 psi, using an LHSV of 7.4 $hr^{-1}$ and a contact time of 4 seconds. The product consisted of 70% b. wt. of a light liquid (API gravity=48.1; boiling range, 30°–400° C.) and 30% b. wt. of $C_1$–$C_4$ gaseous products.

EXAMPLE 9

The feedstock consisted of a heavy (API gravity=12.7; average mol. wt.=713; initial b. p.=160° C.) and highly naphthenic tar sands bitumen (from Asphalt Ridge, Utah), which is solid at room temperature and contains 60% b. wt. of components boiling above 530° C. Sixty grams of this feed was hydropyrolyzed at 525° C. and a hydrogen pressure of 1500 psi, using an LHSV of 1.6 $hr^{-1}$ and a contact time of 18 seconds. The product consisted of 73% b. wt. of a light liquid (API gravity 25.2; average molecular weight=285; distillation range, 20°–400° C.), and 27% b. wt. of $C_1$–$C_4$ gaseous products.

EXAMPLE 10

The feedstock was the same as in Example 9. Seventy-two grams of this feed was hydropyrolyzed at 500° C. and a hydrogen pressure of 1500 psi, using an LHSV of 1.2 $hr^{-1}$ and a contact time of 18 seconds. The product consisted of 83% b. wt. of a light liquid (API gravity=22.1; average molecular weight=336; distillation range, 105°–450° C.), and 17% b. wt. of gaseous products.

EXAMPLE 11

The starting material consisted of a heavy (initial b. p. 160° C.) and highly aromatic coal-derived liquid (Synthoil), which contained 45% b. wt. of components boiling above 500° C. Fifty grams of this feed was hydropyrolyzed at 525° C. and a hydrogen pressure of 1500 psi, using an LHSV of 3.0 $hr^{-1}$ and a contact time of 12 seconds. The product consisted of 74% b. wt. of a light liquid distilling between 50°–390° C., and 26% b. wt. of $C_1$–$C_4$ gaseous products.

EXAMPLE 12

The feestock consisted of a heavy California native oil (initial b. p. 150° C.; containing 30% b. wt. of components boiling above 538° C.). The hydropyrolysis conditions were the same as in Example 11. The product consisted of 89% b. wt. of a light liquid, distilling completely between 50°–520° C., and 11% b. wt. of $C_1$–$C_4$ gaseous products.

EXAMPLE 13

The feedstock consisted of a heavy Alberta native oil (initial b. p. 130° C.; containing 27% b. wt. of components boiling above 538° C.). Hydropyrolysis was performed under the same operating conditions as in Example 11. The product consisted of 86% b. wt. of a light liquid, distilling to the extent of 98% between 50°–530° C., and 14% b. wt. of $C_1$–$C_4$ gaseous products.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a United States Letters Patent is:

1. A flow process for upgrading higher molecular weight, hydrocarbonaceous feedstocks into lower molecular weight, liquid, hydrocarbonaceous products in the absence of a highly turbulent flow comprising:

obtaining a higher molecular weight, hydrocarbonaceous feedstock;

pressurizing the feedstock under a hydrogen atmosphere within a hydrogen pressure range on the order of about 120 psi to 2250 psi; and producing lower molecular weight, liquid products from the feedstock with minimal consumption of hydrogen and in the absence of a catalyst by heating the feedstock-hydrogen mixture to a temperature within the range on the order of about 450° C. to 650° C. while limiting process flow of the mixture to significantly less than a highly turbulent flow.

2. The process defined in claim 1 wherein the obtaining step comprises selecting the feedstock from the group consisting of coal-derived materials, petroleum crudes, tar sand bitumens, oil shale crudes, heavy native oils, and bottom residues from process streams.

3. The process defined in claim 2 wherein the selecting step further comprises obtaining said feedstock from sources including heavy metal contaminants.

4. The process defined in claim 1 wherein the producing step comprises controlling the cleavage of molecules in the feedstock by selectively limiting the reaction time to a time within the range on the order of about 1 second to 40 seconds while selectively controlling both the hydrogen pressure and the temperature.

5. A flow process for producing lower molecular weight liquid, hydrocarbonaceous products from higher molecular weight, hydrocarbonaceous feedstocks and in the absence of a highly turbulent flow comprising:

hydropyrolyzing higher molecular weight, hydrocarbonaceous feedstocks in the absence of a catalyst and with minimal consumption of hydrogen at a temperature within the range on the order of about 450° C. to 650° C.; and limiting the hydropyrolyzing step so as to produce a product comprising primarily lower molecular weight liquid, hydrocarbonaceous products by quenching cracking of the higher molecular weight, hydrocarbonaceous feedstocks with hydrogen at a pressure within the range on the order of about 120 psi to 2250 psi while limiting process flow to significantly less than a highly turbulent flow.

6. The process defined in claim 5 wherein the process further comprises limiting the contact time to less than 40 seconds.

* * * * *

UNITED STATES PATENT AND TRADEMARK OFFICE

CERTIFICATE OF CORRECTION

PATENT NO. : 4,298,457
DATED : November 3, 1981
INVENTOR(S) : Alex G. Oblad et al.

It is certified that error appears in the above–identified patent and that said Letters Patent are hereby corrected as shown below:

Column 1, line 46, "the" should be --of--
Column 3, line 32, "Roue" should be --Route--
Column 5, line 65, "16..02%" should be --16.02%--
Column 6, line 58, "feestock" should be --feedstock--

Signed and Sealed this

*Sixteenth* Day of *February 1982*

[SEAL]

*Attest:*

GERALD J. MOSSINGHOFF

*Attesting Officer*

*Commissioner of Patents and Trademarks*